US007173642B2

(12) United States Patent
Nureki

(10) Patent No.: US 7,173,642 B2
(45) Date of Patent: Feb. 6, 2007

(54) THERMAL ACTIVATION APPARATUS FOR A HEAT-SENSITIVE ADHESIVE SHEET

(75) Inventor: Shinji Nureki, Chiba (JP)

(73) Assignee: Seiko Instruments Inc. (JP)

( * ) Notice: Subject to any disclaimer, the term of this patent is extended or adjusted under 35 U.S.C. 154(b) by 266 days.

(21) Appl. No.: 10/863,892

(22) Filed: Jun. 8, 2004

(65) Prior Publication Data

US 2004/0257424 A1 Dec. 23, 2004

(30) Foreign Application Priority Data

Jun. 10, 2003 (JP) ..... 2003-165212

(51) Int. Cl.
*B41J 2/38* (2006.01)
*B41J 2/315* (2006.01)

(52) U.S. Cl. ..... 347/187; 347/171

(58) Field of Classification Search ..... 347/171, 347/187

See application file for complete search history.

(56) References Cited

U.S. PATENT DOCUMENTS 5,846,358 A * 12/1998 Nagamoto et al. ..... 156/64
6,031,553 A * 2/2000 Nagamoto et al. ..... 347/171
6,867,792 B2 * 3/2005 Hoshino et al. ..... 347/218
6,947,066 B2 * 9/2005 Sato et al. ..... 347/217

FOREIGN PATENT DOCUMENTS

| | | |
|---|---|---|
| EP | 0639521 | 2/1995 |
| EP | 1088672 | 4/2001 |
| JP | 1179152 | 3/1999 |
| WO | 9633122 | 10/1996 |
| WO | 0216243 | 2/2002 |

OTHER PUBLICATIONS

Patent Abstracts of Japan vol. 1998, No. 13, Nov. 30, 1998 & JP 10 217564 A (Copyer Co Ltd), Aug. 18, 1998.

* cited by examiner

*Primary Examiner*—Stephen Meier
*Assistant Examiner*—Rene Garcia, Jr.
(74) *Attorney, Agent, or Firm*—Adams & Wilks

(57) ABSTRACT

A thermal activation apparatus has a casing which houses a drawing roller that draws a heat-sensitive adhesive sheet through an insertion port and transports the sheet through the casing. A cutter unit cuts the sheet to a predetermined length, a thermal activation unit thermally activates a heat-sensitive adhesive layer of the cut sheet, and a discharge roller discharges the thermally-activated sheet through a discharge port. A CPU controls the cutter unit and the thermal activation unit based on various factors so that the heat-sensitive adhesive layer is thermally activated only when needed.

9 Claims, 4 Drawing Sheets

THERMAL ACTIVATION APPARATUS FOR A HEAT-SENSITIVE ADHESIVE SHEET

BACKGROUND OF THE INVENTION

1. Field of the Invention

The present invention relates to a thermal activation apparatus for a heat-sensitive adhesive sheet, which heats and thermally activates a heat-sensitive adhesive layer formed on one surface of a sheet-like base material.

2. Description of the Prior Art

In recent years, a heat-sensitive adhesive sheet has been used as a sheet put on a product. The heat-sensitive adhesive sheet is a printing medium in which a sheet base material has a heat-sensitive adhesive layer having no adherence in ordinary circumstances but exhibiting its adherence under heating on one surface, and has a printable layer on the other surface. For example, the sheet has been widely used as a POS sheet for food products, distribution sheets, delivery sheets, medical sheets, baggage tags, and labels on bottles and cans.

Proposed as a printer for a heat-sensitive adhesive sheet for effecting printing on such heat-sensitive adhesive sheets is a printer having a thermal activation mechanism where a heat-sensitive adhesive layer of a heat-sensitive adhesive label is heated in contact with a head having plural resistor elements (heater elements) provided on a ceramic substrate as a heat source like a thermal head used for a printing head for a thermal printer (see Patent Document JP 11-079152 A for example).

Referring now to FIG. 4, a general structure for a conventional printer for a heat-sensitive adhesive sheet is described. The printer for a heat-sensitive adhesive sheet of FIG. 4 is composed of a roll containing unit B for holding a rolled, tape-like heat-sensitive adhesive sheet (heat-sensitive adhesive label A), a printing unit C for effecting printing on the heat-sensitive adhesive label A, a cutter unit D for cutting the heat-sensitive adhesive sheet A into a label with a predetermined length, and a thermal activation unit E as a thermal activation apparatus for thermally activating a heat-sensitive adhesive layer of the heat-sensitive adhesive label A.

The printing unit C is constructed of a printing thermal head G having plural heater elements F composed of plural, relatively small resistor elements arranged in a width direction so as to enable dot printing, a printing platen roller H brought into pressure contact with the printing thermal head G (heater elements F), and the like. In FIG. 4, the printing platen roller H is rotated clockwise to transport the heat-sensitive adhesive label A to the right.

The cutter unit D is adapted to cut the heat-sensitive adhesive label A, which has undergone printing with the printing unit C, to an appropriate length and is composed of a movable blade I operated by a drive source (not shown) such as an electric motor with a stationary blade J opposing the movable blade I, and the like.

The thermal activation unit E is constructed of a thermal-activation thermal head L as heating means having a heater element K, a thermal activation platen roller M as transporting means for transporting the heat-sensitive adhesive label A, a drawing roller N for drawing the heat-sensitive adhesive label A fed from the printing unit C side in between the thermal-activation thermal head L (heater element K) and the thermal activation platen roller M, and the like. In FIG. 4, the thermal activation platen roller M is rotated in a direction (counterclockwise direction) opposite to the rotation direction of the printing platen roller H to transport the heat-sensitive adhesive label A in a predetermined direction (to the right).

SUMMARY OF THE INVENTION

The conventional printer for a heat-sensitive adhesive sheet has a printing unit for effecting printing on a printable layer of a heat-sensitive adhesive sheet and a thermal activation unit for thermally activating a heat-sensitive adhesive layer, the unit being integrated, and thus involves the following problems.

(1) It is impossible to selectively perform only one of printing on a printable layer and thermal activation of a heat-sensitive adhesive layer. Accordingly, it is impossible to previously perform printing only on the printable layer and then optionally thermally activate the heat-sensitive adhesive layer to put it onto an object. In other words, so-called "collective labeling" cannot be conducted.

(2) Any general-purpose printer not exclusive to the heat-sensitive adhesive sheet is also capable of printing on the printable layer. However, as discussed above, the conventional printer for the heat-sensitive adhesive sheet has such a structure that printing and thermal activation are performed in succession. Therefore, it is impossible to conduct only thermal activation of the printed heat-sensitive adhesive sheet by using the general-purpose printer. In the end, when using the heat-sensitive adhesive sheet, an additional printer exclusive to a heat-sensitive adhesive sheet is necessary.

An object of the present invention is to provide a thermal activation apparatus for a heat-sensitive adhesive sheet, which is capable of thermally activating a heat-sensitive adhesive layer of the heat-sensitive adhesive sheet as needed and is detachably attachable to a printer as needed.

In order to attain the above-mentioned object, a thermal activation apparatus for a heat-sensitive adhesive sheet according to the present invention includes at least an insertion port through which the heat-sensitive adhesive sheet including a sheet-like base material is inserted with the sheet-like base material having a printable layer formed on one surface and a heat-sensitive adhesive layer formed on the other surface, a first transporting means for transporting the heat-sensitive adhesive sheet inserted through the insertion port, a second transporting means for receiving the heat-sensitive adhesive sheet from the first transporting means and transporting the heat-sensitive adhesive sheet, thermal activation means for heating and thermally activating the heat-sensitive adhesive layer of the heat-sensitive adhesive sheet transported by the second transporting means, cutting means for cutting the heat-sensitive adhesive sheet to a predetermined length, a discharge port through which the heat-sensitive adhesive sheet having the heat-sensitive adhesive layer thermally activated by the thermal activation means is discharged, and controlling means for controlling the first transporting means and the second transporting means such that the heat-sensitive adhesive sheet temporarily sags between the cutting means and the thermal activation means. Consequently, the heat-sensitive adhesive layer of the heat-sensitive adhesive sheet can be thermally activated as needed. Also, it is possible to cut other portion of the heat-sensitive adhesive sheet concurrently with the thermal activation of a sagging portion of the sheet.

Further, a thermal activation apparatus for a heat-sensitive adhesive sheet according to the present invention includes at least an insertion port through which the printed heat-sensitive adhesive sheet is inserted after being discharged from a printer for effecting printing on a printable layer of the heat-sensitive adhesive sheet including a sheet-like base material having the printable layer formed on one surface and a heat-sensitive adhesive layer formed on the other surface, transporting means for transporting the heat-sensitive adhesive sheet inserted through the insertion port, thermal activation means for heating and thermally activating the heat-sensitive adhesive layer of the heat-sensitive adhesive sheet transported by the transporting means, a discharge port through which the heat-sensitive adhesive sheet having the heat-sensitive adhesive layer thermally activated by the thermal activation means is discharged, and controlling means for controlling at least one of the transporting means and the thermal activation means according to sheet feeding pitch signals output from the printer, whereby the apparatus enables, by utilizing the signals output from the printer, an operation in synchronization with or in consideration of a printing rate of the printer.

Further, the thermal activation apparatus for a heat-sensitive adhesive sheet according to the present invention further includes cutting means for cutting the heat-sensitive adhesive sheet to a predetermined length based on information transmitted from the printer, and controlling means for calculating a time Tw from when the printer starts a printing operation till when the thermal activation means starts a thermal activation operation and a time Tt necessary for a leading edge of the heat-sensitive adhesive sheet printed by the printer to reach the thermal activation means and, when a relationship of $Tw \geqq Tt$ is established, allowing the thermal activation means to start the thermal activation operation after the elapse of the time Tw from when the printer starts the printing operation and, when a relationship of $Tw < Tt$ is established, allowing the thermal activation means to start the thermal activation operation at a point in time when the leading edge of the heat-sensitive adhesive sheet reaches the thermal activation means. Consequently, it is possible to reduce a time lag between the end of the printing operation and the start of the cutting operation as much as possible. As a result, an overall throughput is significantly improved rather than a case where the printing operation, the cutting operation, and the thermal activation operation are independently performed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
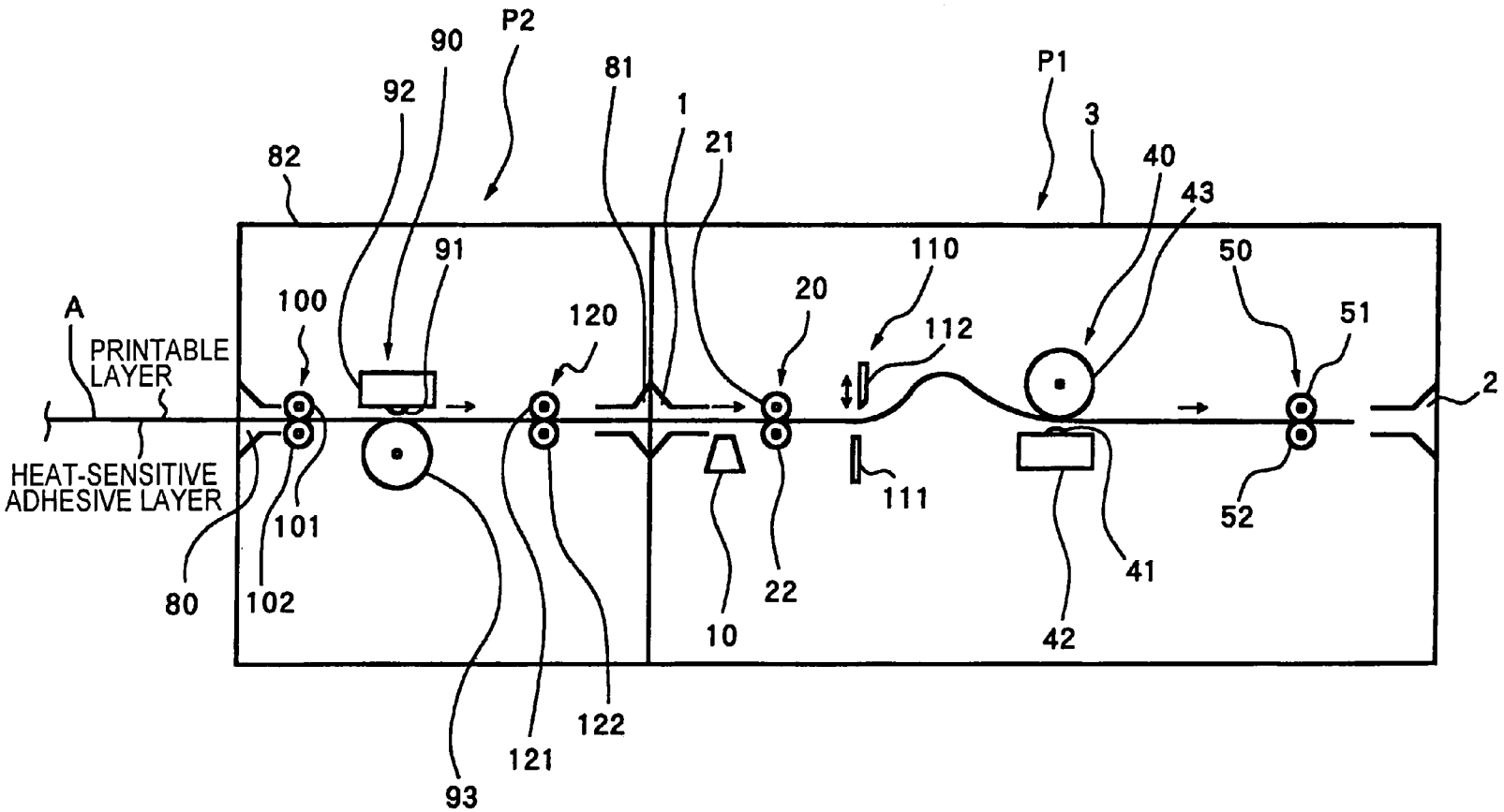
FIG. 1 is a structural view schematically showing a thermal activation apparatus for a heat-sensitive adhesive sheet according to the present invention.
Figure 2:
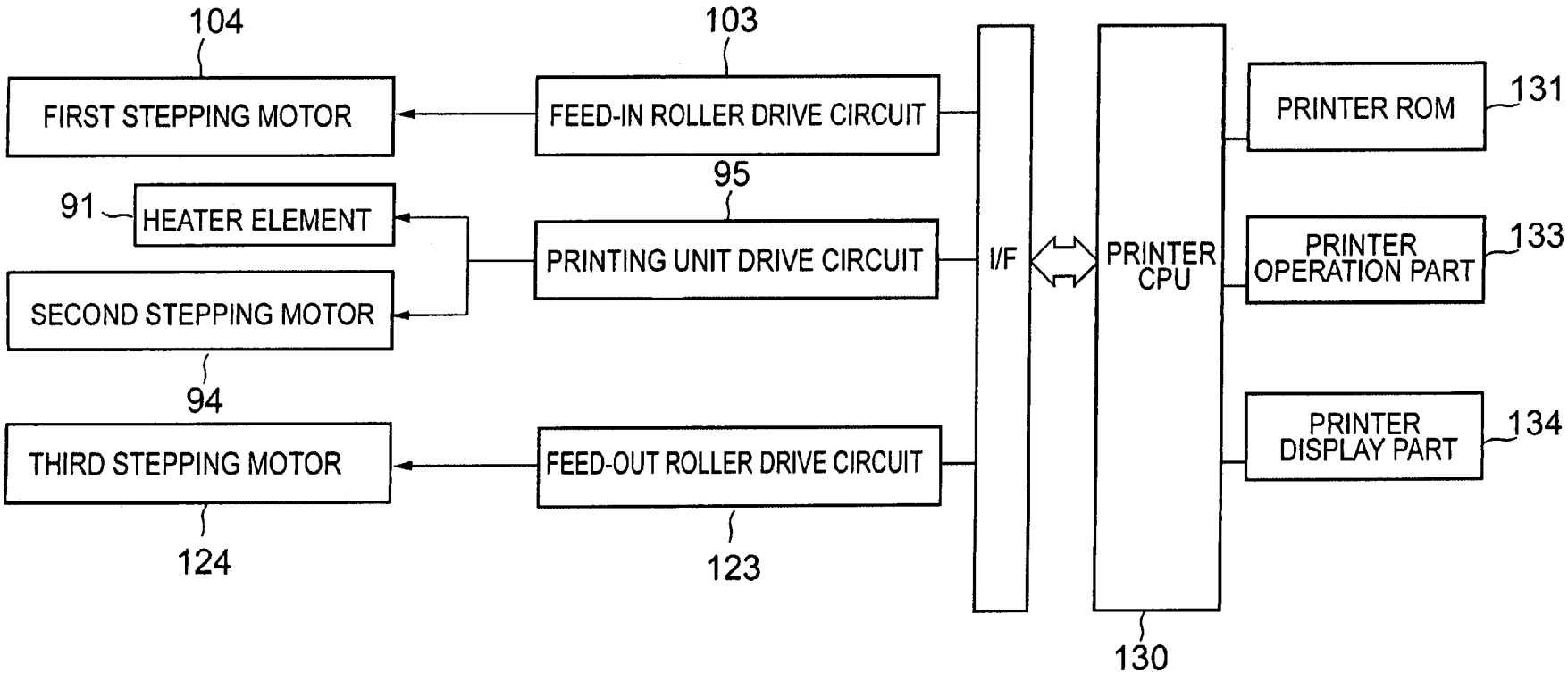
FIG. 2 is a block diagram showing a control system and a drive system of a printer P2 of FIG. 1.
Figure 3:
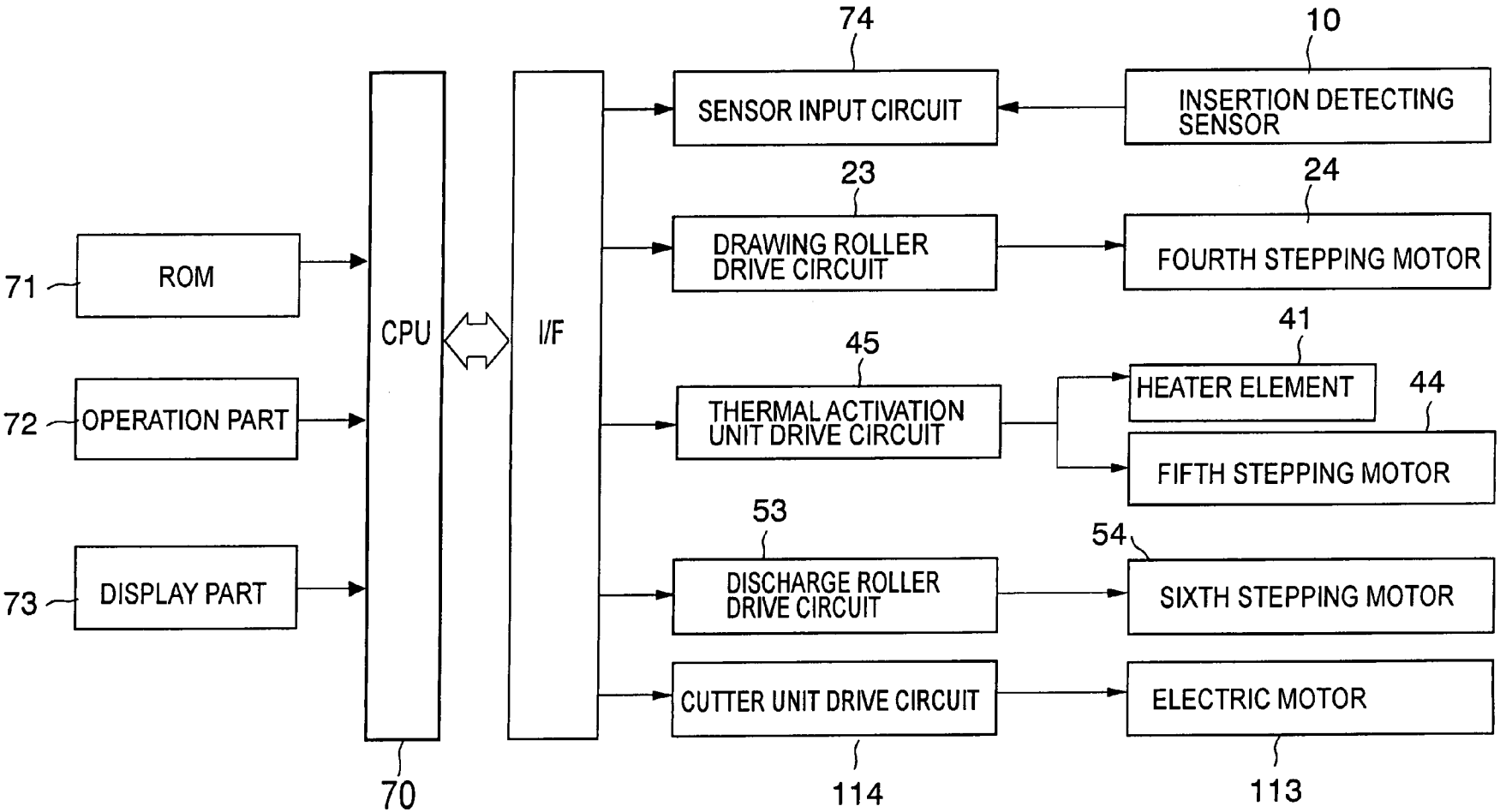
FIG. 3 is a block diagram showing a control system and a drive system of a thermal activation apparatus P1 of FIG. 1.
Figure 4:
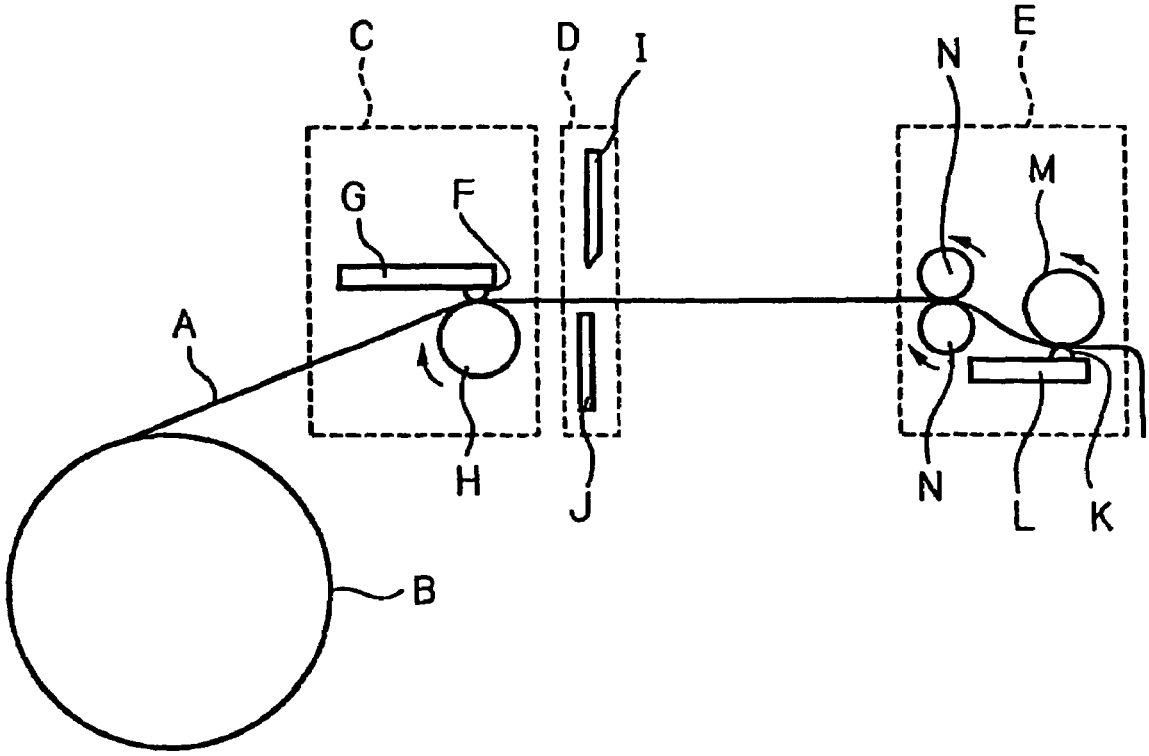
FIG. 4 PRIOR ART
FIG. 4 is a structural view schematically showing a conventional printer for a heat-sensitive adhesive sheet.

Hereinafter, a thermal activation apparatus for a heat-sensitive adhesive sheet according to an embodiment of the present invention will be described in detail with reference to the drawings. FIG. 1 is a schematic diagram showing how a thermal activation apparatus for a heat-sensitive adhesive sheet according to the present invention (hereinafter, referred to as "thermal activation apparatus P1") is mounted to a printer P2 capable of printing on a printable layer of a heat-sensitive adhesive sheet A, the sheet A including a sheet base material having the printable layer on its front surface and a heat-sensitive adhesive layer on its rear surface. FIG. 2 is a block diagram showing a control system and a drive system of the printer P2. FIG. 3 is a block diagram showing a control system and a drive system of the thermal activation apparatus P1. Note that the printer P2 and the thermal activation apparatus P1 are connected to each other in a detachably attachable form by any detaching/attaching means and are individually operable as explained below. The detaching/attaching means may be provided to either the printer P2 or the thermal activation apparatus P1 or to both of them.

The printer P2 shown in FIG. 1 includes a printer casing 82 having a printer insertion port 80 through which the heat-sensitive adhesive sheet A is inserted and a printer discharge port 81 through which the heat-sensitive adhesive sheet A is discharged. Provided inside the printer casing 82 are a printing unit 90 for effecting printing on the printable layer of the heat-sensitive adhesive sheet A, a feed-in roller 100 for transporting the heat-sensitive adhesive sheet A inserted through the printer insertion port 80 to the printing unit 90, and a feed-out roller 120 for discharging to the outside the printed heat-sensitive adhesive sheet A through the printer discharge port 81. Although omitted from FIG. 1, a control system and a drive system of FIG. 2 are also provided inside the printer casing 82. The control system of FIG. 2 is constructed of a printer CPU 130 as controlling means for effecting control over the printing unit 90, the feed-in roller 100, the feed-out roller 120, etc., a printer ROM 131 storing a control program etc. which the printer CPU 130 runs, a printer operation part 133 for inputting various types of necessary data or calling up the input data, a printer display part 134 for displaying the input or output data or other data, and the like. Note that, the drive system of FIG. 2 is described later.

Here, there is no particular limitation on the heat-sensitive adhesive sheet A on which the printer P2 of FIG. 1 can perform printing. For example, such a sheet includes a heat-sensitive adhesive label as disclosed in Patent Document 1 above with the label including a sheet base material having a heat insulating layer and a heat-sensitive color-developing layer (printable layer) on its front surface and a heat-sensitive adhesive layer on its rear surface, the heat-sensitive adhesive layer being formed by applying and drying a heat-sensitive adhesive. A typical heat-sensitive adhesive mainly contains a thermoplastic resin, a solid plastic resin, or the like. However, there is no particular limitation on a composition of the heat-sensitive adhesive as well. The heat-sensitive adhesive sheet also includes a heat-sensitive adhesive label where a protective layer or colored print layer (preprinted layer) is formed on the surface of the heat-sensitive color-developing layer.

The feed-in roller 100 of FIG. 1 is composed of an upper feed-in roller 101 (rotating roller) placed on an upper side across a transport path for the heat-sensitive adhesive sheet A and a lower feed-in roller 102 (rotated roller) placed on a lower side across the same. The upper feed-in roller 101 is connected to a first stepping motor 104 via an unillustrated transmission mechanism, the stepping motor being controlled by the printer CPU 130 through a feed-in roller drive circuit 103 of FIG. 2. On the other hand, the lower feed-in roller 102 is mounted rotatably about a rotation axis. Once the first stepping motor 104 is driven according to a drive signal output from the feed-in roller drive circuit 103 in response to an instruction from the printer CPU 130 of FIG. 2, the upper feed-in roller 101 of FIG. 1 starts rotating counterclockwise. Along with the rotation, the unprinted heat-sensitive adhesive sheet A inserted through the printer insertion port 80 is drawn in between the upper feed-in roller 101 and the lower feed-in roller 102 and transported to the printing unit 90. At this point, the lower feed-in roller 102 is rotated along with the movement of the heat-sensitive adhesive sheet A while bringing the heat-sensitive adhesive sheet A into pressure contact with the upper feed-in roller 101. Of course, the lower feed-in roller 102 may be connected to the first stepping motor 104 to serve as a rotating roller, whereas the upper feed-in roller 101 may serve as a rotated roller.

The printing unit 90 of FIG. 1 is constructed of a printing thermal head 92 having plural heater elements 91 composed of plural, relatively small resistor elements arranged in a width direction so as to enable dot printing, a printing platen roller 93 for transporting the heat-sensitive adhesive sheet A while bringing the printable layer of the sheet in pressure contact with the printing thermal head 92, a second stepping motor 94 of FIG. 2 as a drive source for the printing platen roller 93, a printing unit drive circuit 95 for driving the printing thermal head 92 (heater element 91) and the second stepping motor 94, an unillustrated transmission mechanism for transmitting a torque of the second stepping motor 94 to the printing platen roller 93, and the like.

The printing thermal head 92 of FIG. 1 has the same structure as those of thermal heads used as printing heads for known thermal printers. That is, a protective layer made of crystallized glass is formed on the surface of each of plural heater elements (heating resistor elements) formed on a ceramic substrate by using a thin-film or thick-film formation technique. Therefore, a detailed description thereof is omitted here.

In the printing unit 90 thus structured, once the second stepping motor 94 is driven according to a drive signal output from the printing unit drive circuit 95 in response to an instruction from the printer controlling part 130 of FIG. 2, its torque is transmitted to the printing platen roller 93 via the transmission mechanism. As a result, the printing platen roller 93 starts rotating clockwise. The unprinted heat-sensitive adhesive sheet A transported by the feed-in roller 100 is thereby drawn in between the printing thermal head 92 and the printing platen roller 93 and is fed toward the feed-out roller 120 side while its printable layer comes into pressure contact with the heater element 91. Also, the printing thermal head 92 (heater element 91) starts printing (heating) in accordance with a drive signal output from the printing unit drive circuit 95 concurrently with or after the elapse of a predetermined time from when the printing platen roller 93 starts rotating. Then, the head effects printing on the printable layer.

The printing unit 90 desirably includes pressure means for pressing the printing thermal head 92 against the printing platen roller 93, such as a coil spring or a plate spring, and adjusting means for adjusting a pressing force of the pressure means. The rotation axis of the printing platen roller 93 is desirably kept in parallel to an arrangement direction of the heater elements 91 with a view to uniformly pressing the printable layer over the width direction against the printing thermal head 92 (heater element 91).

The feed-out roller 120 of FIG. 1 is composed of an upper feed-out roller 121 (rotating roller) placed on an upper side across a transport path for the heat-sensitive adhesive sheet A and a lower feed-out roller 122 (rotated roller) placed on a lower side across the same. The upper feed-out roller 121 is connected to a third stepping motor 124 via an unillustrated transmission mechanism, the stepping motor being controlled by the printer CPU 130 through a feed-out roller drive circuit 123 of FIG. 2. On the other hand, the lower feed-out roller 122 is mounted rotatably about a rotation axis. Once the third stepping motor 124 is driven according to a drive signal output from the feed-out roller drive circuit 123 in response to an instruction from the printer CPU 130 of FIG. 2, the upper feed-out roller 121 starts rotating counterclockwise. Along with the rotation, the printed heat-sensitive adhesive sheet A that has passed through the printing unit 90 is drawn in between the upper feed-out roller 121 and the lower feed-out roller 122 and discharged through the printer discharge port 81 to the outside. At this point, the lower feed-out roller 122 is rotated along with the movement of the heat-sensitive adhesive sheet A while bringing the heat-sensitive adhesive sheet A into pressure contact with the upper feed-out roller 121. Of course, the lower feed-out roller 122 may be connected to the third stepping motor 124 to serve as a rotating roller, whereas the upper feed-out roller 121 may serve as a rotated roller.

The printed heat-sensitive adhesive sheet A thus discharged through the printer discharge port 81 of the printer P2 of FIG. 1 is fed into the thermal activation apparatus P1 in the figure, in which the heat-sensitive adhesive layer is thermally activated.

The thermal activation apparatus P1 of FIG. 1 includes a casing 3 having an insertion port 1 through which the heat-sensitive adhesive sheet A discharged through the printer discharge port 81 is fed and a discharge port 2 through which the heat-sensitive adhesive sheet A having the thermally activated heat-sensitive adhesive layer is discharged. Arranged along the transport path for the heat-sensitive adhesive sheet A inside the casing 3 are an insertion detecting sensor 10, a drawing roller 20, a cutter unit 110, a thermal activation unit 40, and a discharge roller 50. Although omitted from FIG. 1, a control system and a drive system of FIG. 3 are also provided inside the casing 3. The control system of FIG. 3 is constructed of a CPU 70 as controlling means for effecting control over the insertion detecting sensor 10, the drawing roller 20, the cutter unit 110, the thermal activation unit 40, the discharge roller 50, etc., a ROM 71 storing a control program etc. which the printer CPU 70 runs, an operation part 72 for inputting various types of necessary data or calling up the input data, a display part 73 for displaying the input or output data or other data, and the like. Note that, the drive system of FIG. 3 is described later.

Here, there is no particular limitation on the heat-sensitive adhesive sheet A whose heat-sensitive adhesive layer is thermally activated by the thermal activation apparatus P1. For example, such a sheet includes a heat-sensitive adhesive label as disclosed in Patent Document 1 above, in which a label base material has a heat insulating layer and a heat-sensitive color-developing layer (printable layer) on its front surface and a heat-sensitive adhesive layer on its rear surface, the heat-sensitive adhesive layer being formed by applying and drying a heat-sensitive adhesive. Note that a typical heat-sensitive adhesive mainly contains a thermoplastic resin, a solid plastic resin, or the like. However, there is no particular limitation on a composition of the heat-sensitive adhesive as well. The heat-sensitive adhesive sheet A also includes a heat-sensitive adhesive label where a protective layer or colored print layer (preprinted layer) is formed on the surface of the heat-sensitive color-developing layer.

The insertion port 1 of FIG. 1 is open on a side surface of the casing 3 having a substantially rectangular parallelepiped shape. The discharge port 2 is open on the other side surface of the casing 3, the surface opposing the side surface where the insertion port 1 is open. Note that the heat-sensitive adhesive sheet A can be manually inserted through the insertion port 1 as well. Also, there is no limitation on positions where the insertion port 1 and the discharge port 2 are open; the ports may be both open anywhere but the above-mentioned positions.

The insertion detecting sensor 10 of FIG. 1 is an optical sensor and is arranged closer to the drawing roller 20 than the insertion port 1 is positioned, by a predetermined distance. The insertion detecting sensor 10 optically detects the leading edge of the heat-sensitive adhesive sheet A inserted in the insertion port 1 by a predetermined length or longer and outputs a sensor signal (insertion detection signal) to a sensor input circuit 74 of FIG. 3. The input insertion detection signal is output from the sensor input circuit 74 to the CPU 70 via an interface (I/F 75). Note that the insertion detecting sensor may be a mechanical sensor or other sensor.

The drawing roller 20 of FIG. 1 is composed of an upper drawing roller 21 (rotating roller) placed on an upper side across a transport path for the heat-sensitive adhesive sheet A and a lower drawing roller 22 (rotated roller) placed on a lower side across the same. The upper drawing roller 21 is connected to a fourth stepping motor 24 via an unillustrated transmission mechanism, the stepping motor being controlled by the CPU 70 through a drawing roller drive circuit 23 of FIG. 3. On the other hand, the lower drawing roller 22 is mounted rotatably about a rotation axis. Once the fourth stepping motor 24 is driven according to a drive signal output from the drawing roller drive circuit 23 in response to an instruction from the CPU 70 of FIG. 3, the upper drawing roller 21 of FIG. 1 starts rotating counterclockwise. Along with the rotation, the heat-sensitive adhesive sheet A inserted through the insertion port 1 is drawn in between the upper drawing roller 21 and the lower drawing roller 22 and transported to the cutter unit 110 side. At this point, the lower drawing roller 22 is rotated along with the movement of the heat-sensitive adhesive sheet A while bringing the heat-sensitive adhesive sheet A into pressure contact with the upper drawing roller 21. Of course, the lower drawing roller 22 may be connected to the fourth stepping motor 24 to serve as a rotating roller, whereas the upper drawing roller 21 may serve as a rotated roller.

The cutter unit 110 of FIG. 1 is constructed of a stationary blade 111 placed on a lower side across the transport path for the heat-sensitive adhesive sheet A, a movable blade 112 approaching and leaving the stationary blade 111 in a reciprocable fashion, which is placed on an upper side across the same, an electric motor 113 of FIG. 3 as a drive source for the movable blade 112, a cutter unit drive circuit 114, and the like. In the cutter unit 110 with such a structure, when the electric motor 113 is driven by the cutter unit drive circuit 114 in response to an instruction from the CPU 70 of FIG. 3, the movable blade 112 moves down to approach the stationary blade 111 to thereby cut the heat-sensitive adhesive sheet A on the transport path and then moves upward to its original position.

The thermal activation unit 40 of FIG. 1 is composed of a thermal-activation thermal head 42 having plural heater elements 41 for heating and thermally activating the heat-sensitive adhesive layer of the heat-sensitive adhesive sheet A, a thermal activation platen roller 43 for transporting the heat-sensitive adhesive sheet A while bringing the heat-sensitive adhesive layer into pressure contact with the thermal-activation thermal head 42, a fifth stepping motor 44 of FIG. 3 as a drive source for the thermal activation platen roller 43, a thermal activation unit drive circuit 45 for driving the thermal-activation thermal head 42 (heater element 41) and the fifth stepping motor 44, an unillustrated transmission mechanism for transmitting a torque of the fifth stepping motor 44 to the thermal activation platen roller 43, and the like.

The thermal-activation thermal head 42 has the same structure as those of thermal heads used as printing heads for known thermal printers. That is, a protective layer made of crystallized glass is formed on the surface of each of plural heater elements (heating resistor elements) formed on a ceramic substrate by using a thin-film or thick-film formation technique. The use of the printing thermal head as the thermal-activation thermal head 42 thus enables a cost reduction. Note that the heater elements 41 of the thermal-activation thermal head 42 do not need to take a divided form on a dot basis as in the heater elements in the printing thermal head but may constitute continuous resistor elements.

In the thermal activation unit 40 thus structured, once the fifth stepping motor 44 is driven according to a drive signal output from the thermal activation unit drive circuit 45 in response to an instruction from the CPU 70 of FIG. 3, the thermal activation platen roller 43 of FIG. 1 starts rotating counterclockwise. Along with the rotation, the heat-sensitive adhesive sheet A that has passed through the cutter unit 110 is drawn in between the thermal-activation thermal head 42 and the thermal activation platen roller 43 and is fed toward the discharge roller 50 side while its heat-sensitive adhesive layer comes into pressure contact with the heater element 41. At the same time, the thermal-activation thermal head 42 (heater element 41) starts thermal activation (heating) in accordance with a drive signal output from the thermal activation unit drive circuit 45 to thereby heat and thermally activate the heat-sensitive adhesive layer of the heat-sensitive adhesive sheet A.

The thermal activation unit 40 desirably includes pressure means for pressing the thermal-activation thermal head 42 against the thermal activation platen roller 43, such as a coil spring or a plate spring, and adjusting means for adjusting a pressing force of the pressure means. The rotation axis of the thermal activation platen roller 43 is desirably kept in parallel to an arrangement direction of the heater elements 41 with a view to uniformly pressing the heat-sensitive adhesive layer over the width direction against the thermal-activation thermal head 42 (heater element 41).

The discharge roller 50 of FIG. 1 is composed of an upper discharge roller 51 (rotating roller) placed on an upper side across a transport path for the heat-sensitive adhesive sheet A and a lower discharge roller 52 (rotated roller) placed on a lower side across the same. The upper discharge roller 51 is connected to a sixth stepping motor 54 via an unillustrated transmission mechanism, the stepping motor being controlled by the CPU 70 through a discharge roller drive circuit 53 of FIG. 3. On the other hand, the lower discharge roller 52 is mounted rotatably about a rotation axis. Once the sixth stepping motor 54 is driven according to a drive signal output from the discharge roller drive circuit 53 in response to an instruction from the CPU 70 of FIG. 3, the upper discharge roller 51 of FIG. 1 starts rotating counterclockwise. Along with the rotation, the heat-sensitive adhesive sheet A whose heat-sensitive adhesive layer is thermally activated by the thermal activation unit 40 is drawn in between the upper discharge roller 51 and the lower discharge roller 52 and discharged to the outside through the discharge port 2. At this point, the lower discharge roller 52 is rotated along with the movement of the heat-sensitive adhesive sheet A while bringing the heat-sensitive adhesive sheet A into pressure contact with the upper discharge roller 51. Of course, the lower discharge roller 52 may be connected to the sixth stepping motor 54 to serve as a rotating roller, whereas the upper discharge roller 51 may serve as a rotated roller.

An explanation has been so far given separately on a relationship among the CPU 70, the drawing roller 20, the cutter unit 110, the thermal activation unit 40, and the discharge roller 50 for simplicity of explanation. However, in practice, the CPU 70 as overall controlling means controls the drawing roller 20, the cutter unit 110, the thermal activation unit 40, the discharge roller 50, etc. in parallel. For example, an overall throughput improves in the case where a cutting operation with the cutter unit 110 and a thermal activation operation with the thermal activation unit 40 are concurrently carried out rather than the case where the thermal activation operation with the thermal activation unit 40 is conducted after the cutting operation with the cutter unit 110 is completely finished. However, when the heat-sensitive adhesive sheet A is cut by the cutter unit 110, the transport of the heat-sensitive adhesive sheet A should be temporarily suspended. Meanwhile, suspending the transport of the heat-sensitive adhesive sheet A during the thermal activation with the thermal activation unit 40 causes a problem in that the heat-sensitive adhesive layer thermally activated sticks to the thermal-activation thermal head 42, and the like. To that end, the CPU 70 controls the drawing roller 20 and the thermal activation platen roller 43 so as to temporarily sag the heat-sensitive adhesive sheet A between the cutter unit 110 and the thermal activation unit 40. More specifically, a transport rate of the drawing roller 20 is set higher than that of the thermal activation platen roller 43 or a drive start timing of the thermal activation platen roller 43 is set with a predetermined delay from a transport start timing of the drawing roller 20. As a result, the heat-sensitive adhesive sheet A is made to temporarily sag. The sheet is cut while the drawing roller 20 comes to a standstill and a sagging portion of the heat-sensitive adhesive sheet A is thermally activated. Thus, the heat-sensitive adhesive sheet A can be cut without bringing the thermal activation platen roller 43 to a standstill (without suspending the thermal activation).

In light of the above, it is necessary for the heat-sensitive adhesive sheet A to sag by a length not smaller than the sum of a length L1 (mm) of the heat-sensitive adhesive sheet A by which the thermal activation platen roller 43 transports the sheet during a cutting time Tc necessary for the cutter unit 110 to cut the heat-sensitive adhesive sheet A, and a distance Lh (mm) between the cutter unit 40 and the thermal-activation thermal head 42. Accordingly, the CPU 70 controls the transport rates, operation timings, and the like of the drawing roller 20 and the thermal activation platen roller 43 through the drawing roller drive circuit 23 and the thermal activation unit drive circuit 45 of FIG. 3 so as to sag the sheet by a length not smaller than the sum of L1+Lh (mm).

Further, for improving the throughput in a usage form as shown in FIG. 1, that is, in a usage form where the heat-sensitive adhesive sheet A whose printable layer undergoes printing with the printer P2 is immediately fed to the thermal activation apparatus P1 and thermally activated, it is desirable to aim at total optimization factoring in the length of the heat-sensitive adhesive sheet A, the distance between the printing thermal head 92 and the thermal-activation thermal head 42, the distance between the cutter unit 40 and the thermal-activation thermal head 42, a printing rate (=transport rate of the printing platen roller 93), an activation rate (=transport rate of the thermal activation platen roller 43), a drive start timing of the thermal-activation thermal head 42 (heater element 41), and the like.

Here, an elapsed time after the insertion detection signal is input is given as one parameter for defining a timing at which the CPU 70 activates the thermal-activation thermal head 42 (heater element 41). For example, the printing rate, the activation rate, and a time period from the insertion detection with the insertion detecting sensor 10 till the activation of the thermal-activation thermal head 42 (heater element 41) are preset. In this case, the CPU 70 measures the elapsed time from the input of the insertion detection signal and issues an instruction to the thermal activation unit drive circuit 45 after the elapse of the preset time, thereby activating the thermal-activation thermal head 42 (heater element. 41). The elapsed time from the input of the insertion detection signal can be used as a parameter except the parameter for defining the timing for activating the thermal-activation thermal head 42 (heater element 41). For example, it is also possible to activate the drawing roller under the condition that the predetermined time elapses after the insertion detection signal is input.

A sensor similar to the insertion detecting sensor 10 can be also placed in front of the discharge port 2 of the casing 3 to thereby control the thermal activation unit 40 so as not to start the next thermal activation operation until the sensor cannot detect the heat-sensitive adhesive sheet A anymore. In other words, provided that the sensor is placed immediately in front of the discharge port 2, the leading edge of the heat-sensitive adhesive sheet A that has passed through the thermal activation unit 40 is detected by the sensor and a detection signal output from the sensor is input to the CPU 70. After that, once a trailing edge of the heat-sensitive adhesive sheet A passes through the sensor (the heat-sensitive adhesive sheet A is wholly discharged through the discharge port 2), the input of the detection signal comes to an end. Accordingly, if the thermal activation unit 40 is allowed to conduct the next thermal activation operation after the input of the detection signal comes to an end, the heat-sensitive adhesive sheet A is not jammed.

In the thermal activation apparatus P1 of FIG. 1, the drive systems for the drawing roller 20, the thermal activation unit 40, and the discharge roller 50 each have the stepping motor. However, if two or more of the drive systems share one stepping motor, the drive systems can be simplified. In this case, functions of the drawing roller drive circuit 23 and the discharge roller drive circuit 53 of FIG. 3 are integrated and assigned to a single motor drive circuit, which enables the simple control system as well. Further, functions concerning the drive of the stepping motor out of the functions of the thermal activation unit are integrated and assigned to the above motor drive circuit, which affords a simpler structure. The drive source for each drive system may be also a DC motor or such other motor except the above stepping motor. It is also possible to allow a two-way or one-way communication with the printer and operate the above components under the control of the printer.

It is also possible to provide the insertion port 1 of the thermal activation apparatus P1 of FIG. 1 with any receiving means such as a plate member capable of guiding to the insertion port 1 the printed heat-sensitive adhesive sheet A discharged through the printer discharge port 81 of the printer P2.

In a printer having a structure in which a printing operation is carried out while any transporting means transports a sheet material, a signal (sheet feeding pitch signal) is generally output each time the sheet material is transported at a predetermined pitch or by a predetermined length. For example, in the printer P2 of FIG. 1, the drive signal output to the second stepping motor 94 from the printing unit drive circuit 95 of FIG. 2 corresponds to the above sheet feeding pitch signal. Also, if any other signals are output in synchronization with the drive signal, the signals are regarded as being equivalent to the sheet feeding pitch signal. Thus, the thermal activation apparatus of the present invention also includes a thermal activation apparatus where means for receiving the above sheet feeding pitch signal from the printer, and means for inputting the received sheet feeding pitch signal to the controlling means are provided to effect control by making use of the sheet feeding pitch signal. An example of the control based on the sheet feeding pitch signal will be explained in detail taking as an example the printer P2 and the thermal activation apparatus P1 of FIG. 1. To perform the aforementioned control, the thermal activation apparatus P1 includes means for taking out a sheet feeding pitch signal output from the printing unit 90 of the printer P2 with a hardware process and means for inputting the received signal to the CPU 70 of FIG. 3. When the sheet feeding pitch signals input to the CPU 70 are counted up to a predetermined number or larger, the CPU 70 issues an instruction to the thermal activation unit drive circuit 45 to activate the thermal-activation thermal head 42. After the input of the sheet feeding pitch signal to the CPU 70 comes to a standstill, the cutter unit 110 is activated to cut the heat-sensitive adhesive sheet A. Further, the thermal activation platen roller 43 is driven in synchronization with the sheet feeding pitch signal. In this case, on account of a given distance between the printing unit 90 and the thermal activation unit 40, the input of the sheet feeding pitch signal comes to a standstill while the thermal activation unit 40 is driven. After the input of the sheet feeding pitch signal comes to a standstill, the CPU 70 autonomously keeps on driving the thermal activation unit 40 until the completion of the thermal activation of the heat-sensitive adhesive sheet A.

In the case where the printer has means for transmitting the sheet feeding pitch signal to the outside, the foregoing control or operation can be also attained by providing means for receiving the sheet feeding pitch signal transmitted from the printer and means for inputting to the CPU the received sheet feeding pitch signal.

An explanation will be made of an example of appropriate control from the view point of maximizing a throughput in a series of operations from printing to the thermal activation as much as possible while using the printer P2 and the thermal activation apparatus P1 of FIG. 1 by way of example. The thermal activation apparatus P1 is provided with communication means for acquiring information on the following items (1) to (6) or the information on the following items (1) to (6) is preset in the thermal activation apparatus P1.

(1) A length of the heat-sensitive adhesive-sheet A: L (mm)
(2) A printing rate of the printing unit 90 (transport rate of the printing platen roller 93): Vp (mm/sec)
(3) A distance between the printing unit 90 and the cutter unit 110: Lp (mm)
(4) A distance between the cutter unit 90 and the thermal activation unit 40: Lh (mm)
(5) A thermal activation rate of the thermal activation unit (transport rate of the thermal activation platen roller 43): Vh (mm/sec)
(6) A cutting time with the cutter unit 110: Tc (sec)

The CPU 70 of the thermal activation apparatus P1, which stores the information on the above items (1) to (6), calculates a time Tw (sec) from when the printing unit 90 starts the printing operation till when the thermal activation unit 40 starts the thermal activation operation based on the following expression:

$$Tw=(L+Lp)/Vp-(L-Lh)/Vh+Tc$$

Further, the CPU 70 calculates a time Tt (sec) necessary for the leading edge of the heat-sensitive adhesive sheet A that has undergone printing with the printing unit 90 to reach the thermal activation unit 40 based on the following expression:

$$Tt=(Lp+Lh)/Vp$$

The CPU 70 compares the calculations from the two expressions and, if a relationship of $Tw \geqq Tt$ is established, allows the thermal activation unit 40 to start the thermal activation operation after the elapse of the time Tw from when the printing unit 90 starts the printing operation. In contrast, if a relationship of $Tw<Tt$ is established, the CPU allows the thermal activation unit 40 to start the thermal activation operation at a point in time when the leading edge of the heat-sensitive adhesive sheet A reaches the thermal activation unit 40. By defining the thermal-activation start timing of the thermal activation unit 40 in this way, it is possible to activate the cutter unit 110 at the time when the trailing edge of the heat-sensitive adhesive sheet A that has undergone printing with the printing unit 90 reaches the cutter unit 110.

Assuming that the information on the above items (1) to (6) and other information are acquired through the two-way or one-way communication with the printer P2, the thermal activation apparatus P1 is preferably provided with a communication connector which is automatically connected to a communication connector provided in the printer P2 once being mounted to the printer P2.

The thermal activation apparatus for a heat-sensitive adhesive sheet according to the present invention includes an insertion port through which the heat-sensitive adhesive sheet including a sheet-like base material is inserted with the sheet-like base material having a printable layer formed on one surface and a heat-sensitive adhesive layer formed on the other surface, a first transporting means for transporting the heat-sensitive adhesive sheet inserted through the insertion port, a second transporting means for receiving the heat-sensitive adhesive sheet from the first transporting means and transporting the heat-sensitive adhesive sheet, thermal activation means for heating and thermally activating the heat-sensitive adhesive layer of the heat-sensitive adhesive sheet transported by the second transporting means, cutting means for cutting the heat-sensitive adhesive sheet to a predetermined length, which is placed between the first transporting means and the second transporting means, a discharge port through which the heat-sensitive adhesive sheet having the heat-sensitive adhesive layer thermally activated by the thermal activation means is discharged, and controlling means for controlling the first transporting means and the second transporting means such that the heat-sensitive adhesive sheet temporarily sags between the cutting means and the thermal activation means.

(1) It is therefore possible to thermally activate the heat-sensitive adhesive layer of the heat-sensitive adhesive sheet printed by a separately provided printer as needed. Also, it is possible to thermally activate the heat-sensitive adhesive layer of the heat-sensitive adhesive sheet in advance and then effect printing on the printable layer with any printing means or writing on the same by hand. Further, the heat-sensitive adhesive sheet can be first put on the object, followed by printing on the printable layer or writing on the same by hand.

(2) It is therefore possible to receive the printed heat-sensitive adhesive sheet discharged from the printer capable of printing on the printable layer of the heat-sensitive adhesive sheet in succession or as required and thermally activate the heat-sensitive adhesive layer of the heat-sensitive adhesive sheet.

(3) It is therefore possible to adopt a usage form where a single apparatus enables both the thermal activation operation and cutting operation of the heat-sensitive adhesive sheet, with which a long sheet on which the same pattern is repeatedly printed or continuous patterns are printed is cut to a required length to thermally activate only the cut portion.

(4) It is therefore possible to perform cutting with the cutting means while the heat-sensitive adhesive sheet is transported by the second transporting means, whereby a throughput improves.

In the case of providing controlling means for controlling the cutting means to cut the heat-sensitive adhesive sheet after a length of the sagging sheet is equal to or larger than a predetermined length, the thermal activation operation and the cutting operation can be concurrently conducted on the heat-sensitive adhesive sheet, whereby the throughput further improves in its entirety.

In the case of providing insertion detecting means for detecting the heat-sensitive adhesive sheet inserted through the insertion port and controlling means for controlling the thermal activation means to start the thermal activation operation after a predetermined time elapses from when the insertion detecting means detects the heat-sensitive adhesive sheet, a thermal-activation start timing can be easily and reliably controlled.

The thermal activation apparatus for a heat-sensitive adhesive sheet according to another aspect of the present invention includes an insertion port through which a printed heat-sensitive adhesive sheet is inserted after being discharged from a printer for effecting printing on a printable layer of the heat-sensitive adhesive sheet including a sheet-like base material having the printable layer formed on one surface and a heat-sensitive adhesive layer formed on the other surface, transporting means for transporting the heat-sensitive adhesive sheet inserted through the insertion port, thermal activation means for heating and thermally activating the heat-sensitive adhesive layer of the heat-sensitive adhesive sheet transported by the transporting means, a discharge port through which the heat-sensitive adhesive sheet having the heat-sensitive adhesive layer thermally activated by the thermal activation means is discharged, and controlling means for controlling at least one of the transporting means and the thermal activation means according to sheet feeding pitch signals output from the printer.

(1) It is therefore possible to perform the thermal activation operation in synchronization with the sheet feeding pitch of the printer to eliminate the need for setting a thermal activation rate on the thermal activation apparatus side.

(2) It is therefore possible to control the thermal-activation start timing of the thermal activation means and the cutting timing of the cutting means according to the sheet feeding pitch signals to simplify the control system in the thermal activation apparatus.

(3) If the sheet feeding pitch signals are taken out from the printer through a hardware process, effects of (1) and (2) above can be obtained with no change of software of the printer.

The thermal activation apparatus for a heat-sensitive adhesive sheet according to the present invention further includes cutting means for cutting the heat-sensitive adhesive sheet to a predetermined length, and controlling means for calculating a time Tw from when the printer starts a printing operation till when the thermal activation means starts a thermal activation operation and a time Tt necessary for a leading edge of the heat-sensitive adhesive sheet printed by the printer to reach the thermal activation means and, when a relationship of $Tw \geqq Tt$ is established, allowing the thermal activation means to start the thermal activation operation after the elapse of the time Tw from when the printer starts the printing operation and, when a relationship of $Tw < Tt$ is established, allowing the thermal activation means to start the thermal activation operation at a point in time when the leading edge of the heat-sensitive adhesive sheet reaches the thermal activation means. Consequently, the time lag between the end of the printing operation in the printer and the start of the cutting operation is reduced as much as possible to thereby considerably improve the total throughput of the operations from the cutting operation to the thermal.

What is claimed is:

1. A thermal activation apparatus for a heat-sensitive adhesive sheet, comprising:

an insertion port through which is inserted a heat-sensitive adhesive sheet including a sheet-like base material having a printable layer formed on one surface and a heat-sensitive adhesive layer formed on the other surface;

first transporting means for transporting the heat-sensitive adhesive sheet inserted through the insertion port;

second transporting means for receiving the heat-sensitive adhesive sheet from the first transporting means and transporting the heat-sensitive adhesive sheet;

cutting means for cutting the heat-sensitive adhesive sheet to a predetermined length, which is placed between the first transporting means and the second transporting means;

thermal activation means for heating and thermally activating the heat-sensitive adhesive layer of the heat-sensitive adhesive sheet transported by the second transporting means;

a discharge port through which the heat-sensitive adhesive sheet having the heat-sensitive adhesive layer thermally activated by the thermal activation means is discharged; and controlling means for controlling the first transporting means and the second transporting means such that the heat-sensitive adhesive sheet temporarily sags between the cutting means and the thermal activation means and for controlling the cutting means to cut the heat-sensitive adhesive sheet after a length of the sagging sheet is equal to or larger than a length corresponding to a sum of a length of the heat-sensitive adhesive sheet transported by the second transporting means within a cutting time of the cutting means and a distance between the cutting means and the thermal activation means.

2. The thermal activation apparatus for a heat-sensitive adhesive sheet as claimed in claim 1, further comprising insertion detecting means for detecting the heat-sensitive adhesive sheet inserted through the insertion port; and wherein the controlling means controls the thermal activation means to start a thermal activation operation after a predetermined time elapses from when the insertion detecting means detects the heat-sensitive adhesive sheet.

3. The thermal activation apparatus for a heat-sensitive adhesive sheet as claimed in claim 1, further comprising discharge detecting means for detecting the heat-sensitive adhesive sheet discharged through the discharge port; and wherein the controlling means controls the thermal activation means not to perform a thermal activation operation while the discharge detecting means detects the heat-sensitive adhesive sheet.

4. A thermal activation apparatus for a heat-sensitive adhesive sheet, comprising:

an insertion port through which is inserted a printed heat-sensitive adhesive sheet after being discharged from a printer for effecting printing on a printable layer of the heat-sensitive adhesive sheet which includes a sheet-like base material having the printable layer formed on one surface and a heat-sensitive adhesive layer formed on the other surface;

transporting means for transporting the heat-sensitive adhesive sheet inserted through the insertion port;

thermal activation means for heating and thermally activating the heat-sensitive adhesive layer of the heat-sensitive adhesive sheet transported by the transporting means;

a discharge port through which the heat-sensitive adhesive sheet having the heat-sensitive adhesive layer thermally activated by the thermal activation means is discharged; and controlling means for controlling at least one of the transporting means and the thermal activation means according to sheet feeding pitch signals output from the printer.

5. The thermal activation apparatus for a heat-sensitive adhesive sheet as claimed in claim 4, wherein the controlling means controls the transporting means such that a transport rate is synchronous with the sheet feeding pitch signals while the sheet feeding pitch signals output from the printer are input.

6. The thermal activation apparatus for a heat-sensitive adhesive sheet as claimed in claim 4, further comprising insertion detecting means for detecting the heat-sensitive adhesive sheet inserted through the insertion port; and wherein the controlling means controls the thermal activation means to start a thermal activation operation after the sheet feeding pitch signals input after the insertion detecting means detects the heat-sensitive adhesive sheet are counted up to a predetermined number or larger.

7. The thermal activation apparatus for a heat-sensitive adhesive sheet as claimed in claim 4, further comprising cutting means for cutting the heat-sensitive adhesive sheet to a predetermined length; and wherein the controlling means controls the cutting means to cut the heat-sensitive adhesive sheet on completion of the input of the sheet feeding pitch signals.

8. The thermal activation apparatus for a heat-sensitive adhesive sheet according to claim 4, further comprising discharge detecting means for detecting the heat-sensitive adhesive sheet discharged through the discharge port; and wherein the controlling means controls the thermal activation means not to perform a thermal activation operation while the discharge detecting means detects the heat-sensitive adhesive sheet.

9. A thermal activation apparatus for a heat-sensitive adhesive sheet, comprising:

an insertion port through which is inserted a printed heat-sensitive adhesive sheet after being discharged from a printer for effecting printing on a printable layer of the heat-sensitive adhesive sheet which includes a sheet-like base material having the printable layer formed on one surface and a heat-sensitive adhesive layer formed on the other surface;

transporting means for transporting the heat-sensitive adhesive sheet inserted through the insertion port;

thermal activation means for heating and thermally activating the heat-sensitive adhesive layer of the heat-sensitive adhesive sheet transported by the transporting means;

a discharge port through which the heat-sensitive adhesive sheet having the heat-sensitive adhesive layer thermally activated by the thermal activation means is discharged;

cutting means for cutting the heat-sensitive adhesive sheet to a predetermined length; and controlling means for controlling the thermal activation means based on information transmitted from the printer and for calculating a time Tw from when the printer starts a printing operation till when the thermal activation means starts a thermal activation operation and a time Tt necessary for a leading edge of the heat-sensitive adhesive sheet printed by the printer to reach the thermal activation means and, when a relationship of $Tw \geqq Tt$ is established, allowing the thermal activation means to start the thermal activation operation after the elapse of the time Tw from when the printer starts the printing operation and, when a relationship of $Tw < Tt$ is established, allowing the thermal activation means to start the thermal activation operation at a point in time when the leading edge of the heat-sensitive adhesive sheet reaches the thermal activation means based on both or one of the information transmitted from the printer and preset information.

* * * * *